US009004196B2

(12) United States Patent
Haugvaldstad et al.

(10) Patent No.: US 9,004,196 B2
(45) Date of Patent: Apr. 14, 2015

(54) DRILL BIT ASSEMBLY HAVING ALIGNED FEATURES

(75) Inventors: Kjell Haugvaldstad, Vanvikan (NO); Derek Logan, Calgary (CA); Garry Holmen, Calgary (CA); Tony R. Dopf, Calgary (CA); Aaron Logan, Calgary (CA); Rob Utter, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 642 days.

(21) Appl. No.: 13/266,086

(22) PCT Filed: Oct. 29, 2009
(Under 37 CFR 1.47)

(86) PCT No.: PCT/CA2009/001567
§ 371 (c)(1),
(2), (4) Date: Jun. 5, 2012

(87) PCT Pub. No.: WO2010/121344
PCT Pub. Date: Oct. 28, 2010

(65) Prior Publication Data

US 2013/0032412 A1 Feb. 7, 2013

Related U.S. Application Data

(60) Provisional application No. 61/172,188, filed on Apr. 23, 2009.

(51) Int. Cl.
*E21B 17/043* (2006.01)
*E21B 10/62* (2006.01)
(Continued)

(52) U.S. Cl.
CPC ..... *E21B 10/00* (2013.01); *E21B 47/122* (2013.01); *Y10S 411/93* (2013.01)

(58) Field of Classification Search
CPC ... E21B 10/62; E21B 17/042; E21B 17/0426; E21B 17/028; E21B 19/16; Y10S 411/93; F16L 13/11; F16L 13/122; F16L 55/175
USPC ..... 175/425, 320, 424, 366, 306, 367, 368; 166/242.8, 380; 285/296.1, 294.3, 285/294.4, 285.1; 411/258, 930, 417–421; 29/527.1
See application file for complete search history.

(56) References Cited

U.S. PATENT DOCUMENTS 2,034,074 A * 3/1936 Wright ..... 403/320
2,052,019 A * 8/1936 Baker ..... 403/343
(Continued)

FOREIGN PATENT DOCUMENTS

CA 2496170 8/2006
CA 2577734 8/2008
(Continued)

*Primary Examiner* — Jennifer H Gay
(74) *Attorney, Agent, or Firm* — Chadwick A. Sullivan; Wesley Noah

(57) ABSTRACT

A drill bit assembly has a bit head and a pin body. The bit head comprises a cutting end, an opposite connecting end with an engagement section, and a feature facing the connecting end. The pin body comprises a tubular body with an axial bore therethrough, a connecting end with an engagement section and a feature facing the connecting end. The drill bit assembly is manufactured by positioning the pin body connecting end with the bit head connecting end such that the pin body and bit head engagement sections overlap with a gap therebetween, and the pin body and bit head features are aligned; injecting a thermoplastic or other connecting material in liquid form between the bit head and pin body engagement sections and into the gap; and solidifying the thermoplastic or other connecting material such that the bit head and pin body are mechanically coupled together at their connecting ends and their features are securely aligned.

25 Claims, 14 Drawing Sheets

(51) Int. Cl.

| | |
|---|---|
| ***F16L 47/00*** | (2006.01) |
| ***F16B 39/10*** | (2006.01) |
| ***E21B 10/00*** | (2006.01) |
| ***E21B 47/12*** | (2012.01) |

(56) References Cited

U.S. PATENT DOCUMENTS

| | | | | | |
|---|---|---|---|---|---|
| 2,087,185 | A | * | 7/1937 | Dillon | 285/111 |
| 2,122,808 | A | * | 7/1938 | Catland | 175/340 |
| 2,497,185 | A | * | 2/1950 | Reistle, Jr. | 175/233 |
| 3,182,736 | A | * | 5/1965 | Pitifer | 175/413 |
| 3,897,713 | A | * | 8/1975 | Gugle | 411/389 |
| 4,413,689 | A | | 11/1983 | Hughes et al. | |
| 4,494,618 | A | * | 1/1985 | Radtke | 175/393 |
| 4,545,441 | A | * | 10/1985 | Williamson | 175/431 |
| 4,674,773 | A | * | 6/1987 | Stone et al. | 285/48 |
| 5,224,953 | A | | 7/1993 | Morgentaler | |
| 5,265,682 | A | | 11/1993 | Russell et al. | |
| 5,441,121 | A | * | 8/1995 | Tibbitts | 175/417 |
| 5,520,255 | A | | 5/1996 | Barr et al. | |
| 5,553,678 | A | | 9/1996 | Barr et al. | |
| 5,553,679 | A | | 9/1996 | Thorp | |
| 5,582,259 | A | | 12/1996 | Barr | |
| 5,603,385 | A | | 2/1997 | Colebrook | |
| 5,666,864 | A | * | 9/1997 | Tibbitts | 76/108.2 |
| 5,673,763 | A | | 10/1997 | Thorp | |
| 5,685,379 | A | | 11/1997 | Barr et al. | |
| 5,695,015 | A | | 12/1997 | Barr et al. | |
| 5,706,905 | A | | 1/1998 | Barr | |
| 5,778,992 | A | | 7/1998 | Fuller | |
| 5,803,185 | A | | 9/1998 | Barr et al. | |
| 5,971,085 | A | | 10/1999 | Colebrook | |
| 6,050,353 | A | | 4/2000 | Logan et al. | |
| 6,089,332 | A | | 7/2000 | Barr et al. | |
| 6,092,610 | A | | 7/2000 | Kosmala et al. | |
| 6,123,561 | A | * | 9/2000 | Turner et al. | 439/194 |
| 6,158,529 | A | | 12/2000 | Dorel | |
| 6,244,361 | B1 | | 6/2001 | Comeau et al. | |
| 6,364,034 | B1 | | 4/2002 | Schoeffler | |
| 6,394,193 | B1 | | 5/2002 | Askew | |
| 7,387,167 | B2 | | 6/2008 | Fraser et al. | |
| 7,900,968 | B2 | * | 3/2011 | Camwell et al. | 285/47 |
| 7,997,346 | B2 | * | 8/2011 | Marshall | 166/378 |
| 8,042,841 | B2 | * | 10/2011 | Viegener | 285/333 |
| 8,130,117 | B2 | * | 3/2012 | Hall et al. | 340/853.1 |
| 8,308,199 | B2 | * | 11/2012 | Camwell et al. | 285/47 |
| 8,309,018 | B2 | * | 11/2012 | Smith et al. | 419/6 |
| 8,381,844 | B2 | * | 2/2013 | Matthews et al. | 175/425 |
| 2001/0052428 | A1 | | 12/2001 | Larronde et al. | |
| 2002/0011359 | A1 | | 1/2002 | Webb et al. | |
| 2003/0155768 | A1 | * | 8/2003 | Hollingsworth et al. | 285/333 |
| 2004/0104047 | A1 | * | 6/2004 | Peter | 175/40 |
| 2007/0229304 | A1 | * | 10/2007 | Hall et al. | 340/853.1 |
| 2008/0191900 | A1 | * | 8/2008 | Camwell et al. | 340/854.3 |
| 2010/0043229 | A1 | * | 2/2010 | Camwell et al. | 29/890.14 |
| 2010/0270086 | A1 | * | 10/2010 | Matthews et al. | 175/425 |
| 2010/0329081 | A1 | * | 12/2010 | Sullivan et al. | 367/120 |
| 2012/0031669 | A1 | * | 2/2012 | Foster | 175/45 |
| 2012/0031670 | A1 | * | 2/2012 | Trinh et al. | 175/50 |
| 2012/0031672 | A1 | * | 2/2012 | Trinh et al. | 175/57 |
| 2012/0085583 | A1 | * | 4/2012 | Logan et al. | 175/50 |
| 2013/0032412 | A1 | * | 2/2013 | Haugvaldstad et al. | 175/425 |
| 2013/0043874 | A1 | * | 2/2013 | Clark et al. | 324/369 |
| 2013/0048381 | A1 | * | 2/2013 | Habernal et al. | 175/50 |

FOREIGN PATENT DOCUMENTS

| | | | | | |
|---|---|---|---|---|---|
| GB | 525800 | A | * | 9/1940 | E21B 17/04 |
| GB | 2064041 | | | 6/1981 | |

* cited by examiner

DRILL BIT ASSEMBLY HAVING ALIGNED FEATURES

CROSS-REFERENCE TO RELATED APPLICATIONS

The present document is based on and claims priority to U.S. Provisional Application Ser. No. 61/172,188, filed Apr. 23, 2009, which is incorporated herein by reference in its entirety.

FIELD OF THE INVENTION

This invention relates generally to drilling equipment used in drilling bore holes in earth formations, and in particular to a method and apparatus for aligning features in a bit head and a pin body of a drill bit assembly.

BACKGROUND OF THE INVENTION

A conventional drill bit assembly used in downhole directional drilling applications typically comprises a matrix head and a mating pin body. In one type of drill bit assembly, the bit head is a one-piece structure typically made of tungsten carbide. In some drill bit assemblies, a locking ring is provided which mechanically fastens to the matrix head, and which can be welded to the pin body to ensure a secure connection between matrix head and pin body. In another type of drill bit assembly, the matrix head is made of two materials, namely a tungsten carbide crown which is brazed onto a steel pin.

A typical matrix head has a female threaded bore that extends partway into the matrix head, and mates with a male threaded pin end of the pin body. Prior to making up these two parts, a steel polymer material such as Megasteel™ is applied to the threads to provide sealing as well as to add strength to the connection.

When making up the pin body to the matrix head, a predetermined amount of torque is applied to the two parts by a make-up machine. Due to the geometry of the threads, there is no method of precisely achieving a specific rotational alignment between the pin body and the matrix head during the make-up procedure. Therefore, it is difficult to provide features in the matrix head or pin that need to communicate or connect with features in the other of the matrix head, when such communication or connection requires precise alignment of the matrix head and pin body.

For drill bit assemblies that use a locking ring, the locking ring is typically locked mechanically to the matrix head by inserting keys in the matrix head into matching keyholes in the locking ring. After the matrix head and pin body are made up, the locking ring is located in proximity to the pin body such that a weld can be applied around the circumference of the locking ring and the pin body to secure these two parts together. The weld ensures that no relative rotation between the pin body and the matrix will occur during drilling. While the weld is effective to prevent relative rotation, applying an effective weld requires care, skill and time, thereby adding to the complexity and cost of the matrix head assembly process.

SUMMARY OF THE INVENTION

According to one aspect of the invention, there is provided a method of manufacturing a drill bit assembly having a bit head and a pin body. The bit head has a cutting end, an opposite connecting end with an engagement section, and a feature such as a communications port facing the bit head connecting end. The pin body has a connecting end with an engagement section and a feature such as a communications port facing the pin body connecting end. The method comprises: positioning the pin body and matrix head connecting ends such that the matrix head and pin body engagement sections overlap with a gap therebetween and the matrix head and pin body features are aligned; injecting a connecting material in liquid form into the gap; and solidifying the connecting material such that the bit head and pin body are mechanically coupled together at their connecting ends and the features are securely aligned.

The matrix head connecting end can be female, and the pin body connecting end can be male, and the pin body and bit head are positioned by inserting the pin body connecting end into the bit head connecting end.

The connecting material can be a thermoplastic material, which can be a dielectric material. In particular, the thermoplastic material can comprises a liquid crystal polymer resin reinforced by glass fiber.

The drill bit assembly can further comprise a cavity in at least one of the bit head engagement section and the pin body engagement section. In which case, the method can further comprise injecting a thermoplastic material in liquid form between the bit head and pin body engagement sections such that the gap and the cavity are filled, and solidifying the thermoplastic material to form a gap joint which fills the gap and a segment of thermoplastic material that protrudes into the cavity.

The bit head and pin body engagement sections can be threaded with matching threads, in which case the method further comprises injecting the thermoplastic material in liquid form between the threads of the bit head and pin body engagement sections.

Each cavity can be an elongated groove extending substantially parallel to an axis of the bit head and pin body and across multiple threads of at least one of the bit head and pin body engagement sections. In which case, the method further comprises injecting the thermoplastic material in liquid form between the bit head and pin body engagement sections such that the gap and the groove are filled, and solidifying the thermoplastic material to form a gap joint in the gap and a segment of thermoplastic material that protrudes into the groove.

According to another aspect of the invention, there is provided a drill bit assembly comprising: a bit head having a cutting end, an opposite connecting end with an engagement section, and a feature facing the connecting end; and a pin body having a connecting end with an engagement section and a feature facing the connecting end. The bit head and pin body connecting ends are positioned such that the bit head and pin body engagement sections overlap with a gap therebetween and the bit head and pin body features are aligned. The drill bit assembly also comprises a connecting material comprising a gap joint located in the gap such that the bit head and pin body are mechanically coupled together at their connecting ends, and a segment protruding into each cavity to impede the rotation of the bit head relative to the pin body. The drill bit assembly can further comprise a cavity in at least one of the bit head engagement section and pin body engagement section. A segment of the gap joint can fill the cavity to impair rotation of the bit head relative to the pin body.

Each cavity can be an elongated groove extending substantially parallel to an axis of the bit head and pin body and across at least one of the bit head and pin body engagement sections. Alternatively, each cavity is an elongated groove extending at an acute angle to an axis of the bit head and pin body and across at least one of the bit head and pin body engagement sections. The bit head and pin body engagement sections can be threaded with matching threads, and each groove can extend across multiple threads, in which case the connecting material is located between and around the matching threads. The connecting material can be a thermoplastic.

The bit head and pin body engagement sections can be threaded with matching threads, and the drill bit assembly can comprise multiple cavities in the form of elongated grooves arranged in a single front-to-tail line and in a reverse thread pattern to the matching threads.

The drill bit assembly can comprise multiple cavities each in the form of a circular dimple and arranged in at least one spaced row extending across at least one of the bit head and pin body engagement sections.

According to yet another aspect of the invention, there is provided a method of manufacturing a drill bit assembly having a bit head and a pin body wherein at least one of the bit head and pin body has two mating pieces connected together by a gap joint. The bit head comprises a cutting end and an opposite connecting end with an engagement section. The pin body comprises a tubular body with an axial bore therethrough and a connecting end with an engagement section. At least one of the bit head and pin body comprises two mating pieces each with mating ends and a feature thereon. This method comprises: positioning the engagement sections of the pin body and the bit head such that the pin body and the bit head are connected at their connecting ends; positioning the mating ends of the two pieces of the pin body or the bit head or both such that a gap is formed between the mating ends, and the features in each mating end are aligned; injecting a connecting material in liquid form between the mating ends and into the gap; and solidifying the connecting material such that the two pieces of the pin body or bit head or both are mechanically coupled together at their mating ends and their features are securely aligned.

According to yet another aspect of the invention, there is provided a drill bit assembly comprising: a bit head having a cutting end and an opposite connecting end with an engagement section; and a pin body having a connecting end with an engagement section. The pin body and bit head connecting ends are positioned such that the bit head and pin body engagement sections overlap and the pin body and bit head are connected at their connecting ends. At least one of the bit head and pin body comprises two mating pieces each with a mating end and a feature thereon; the mating ends are positioned such that a gap is formed therebetween and the features are aligned. A gap joint fills the gap such that the two pieces of the bit head or pin body or both are mechanically coupled together at their mating ends. The pin body and bit head connecting ends can be positioned such that a gap is formed between the bit head and pin body engagement sections, and in which case, the drill bit assembly further comprises a second gap joint filling the gap such that the bit head and pin body are mechanically coupled together at their connecting ends.

DETAILED DESCRIPTION OF EMBODIMENTS OF THE INVENTION

Drill String

Figure 1:
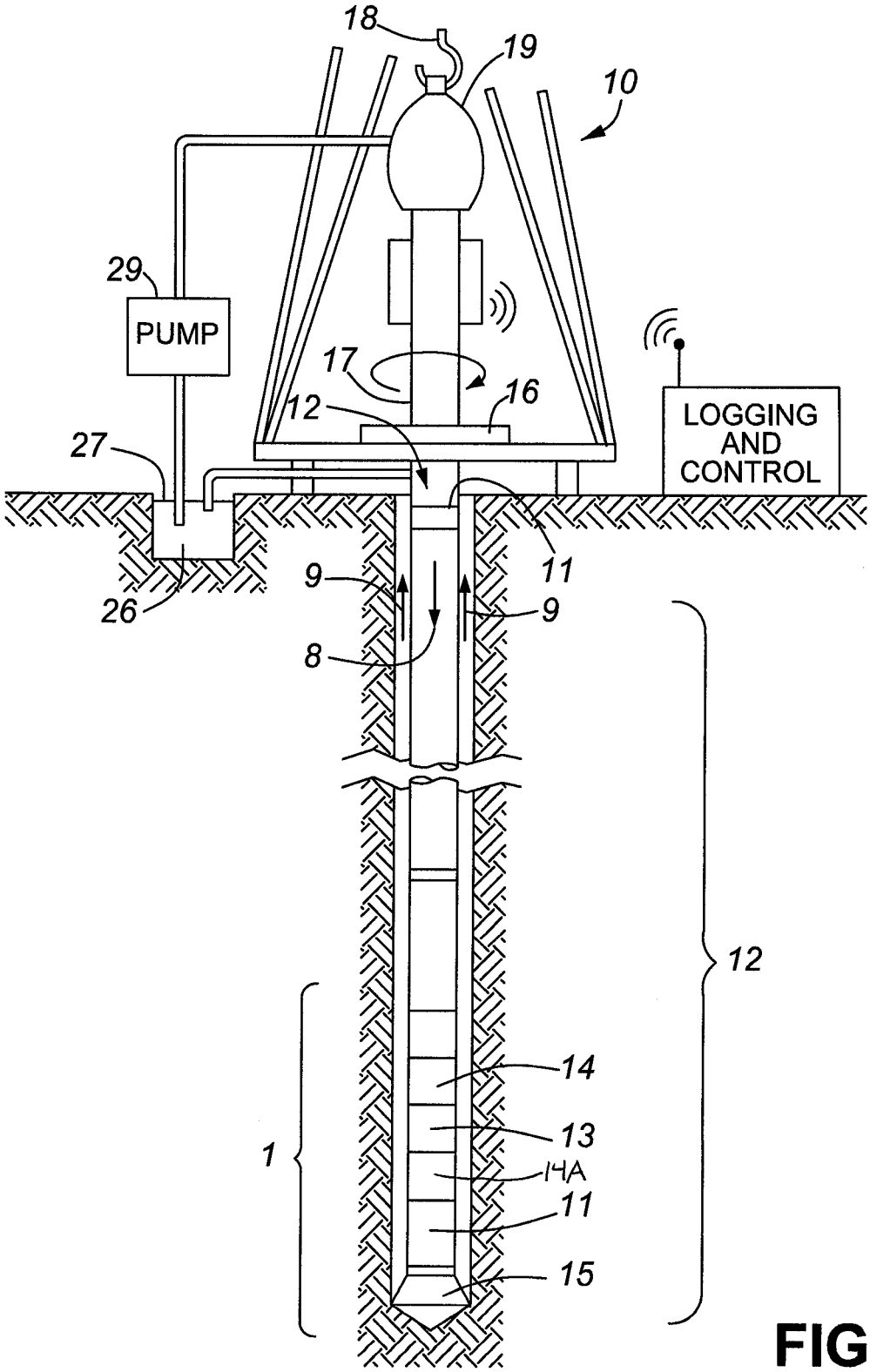
FIG. 1 is a schematic of a drill bit assembly attached to other components in a drill string according to one embodiment of the invention, in use in a well site.
Figure 2:
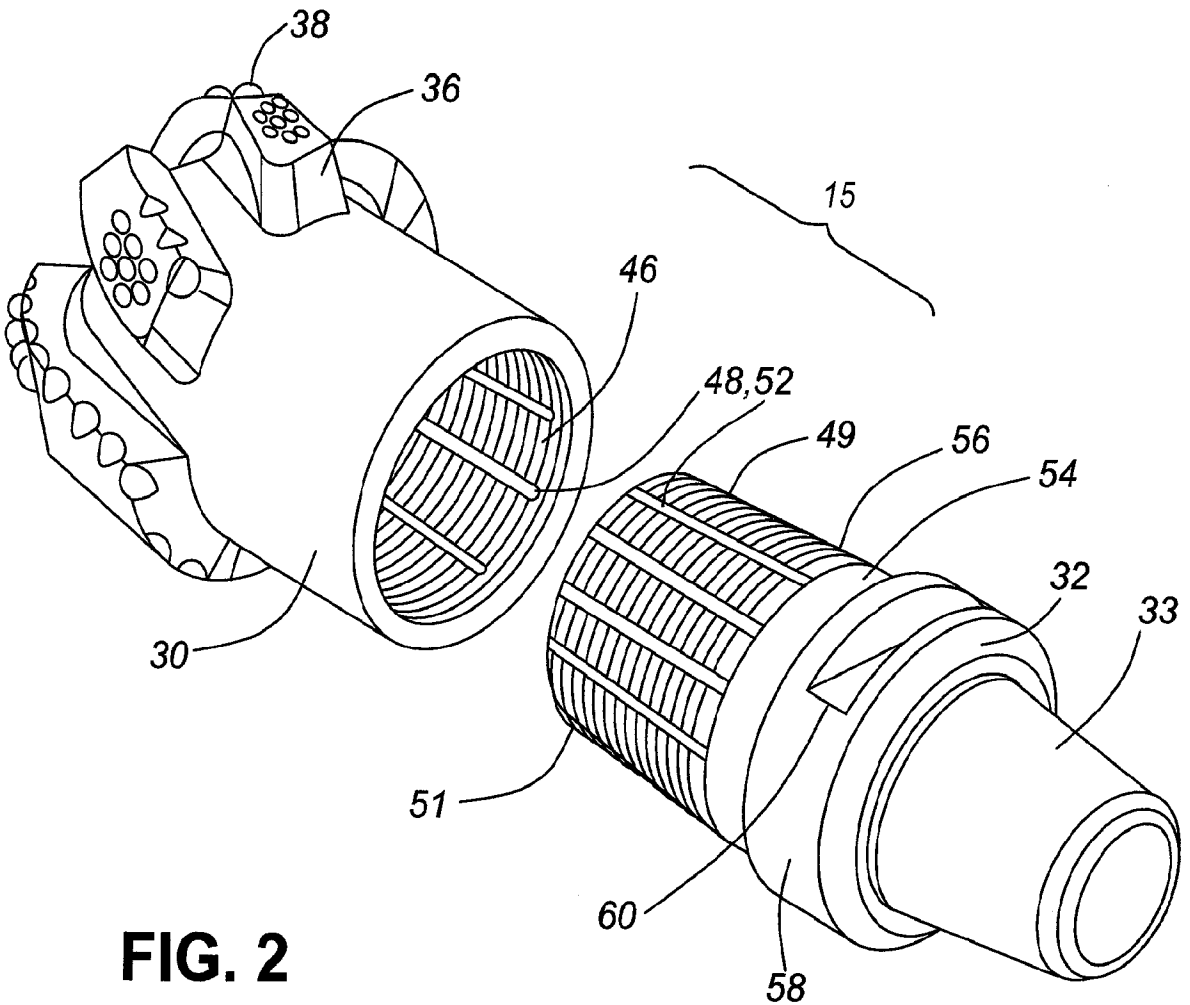
FIG. 2 is a perspective view of a bit head and a double pin body of the drill bit assembly in disassembled form.
Figure 3:
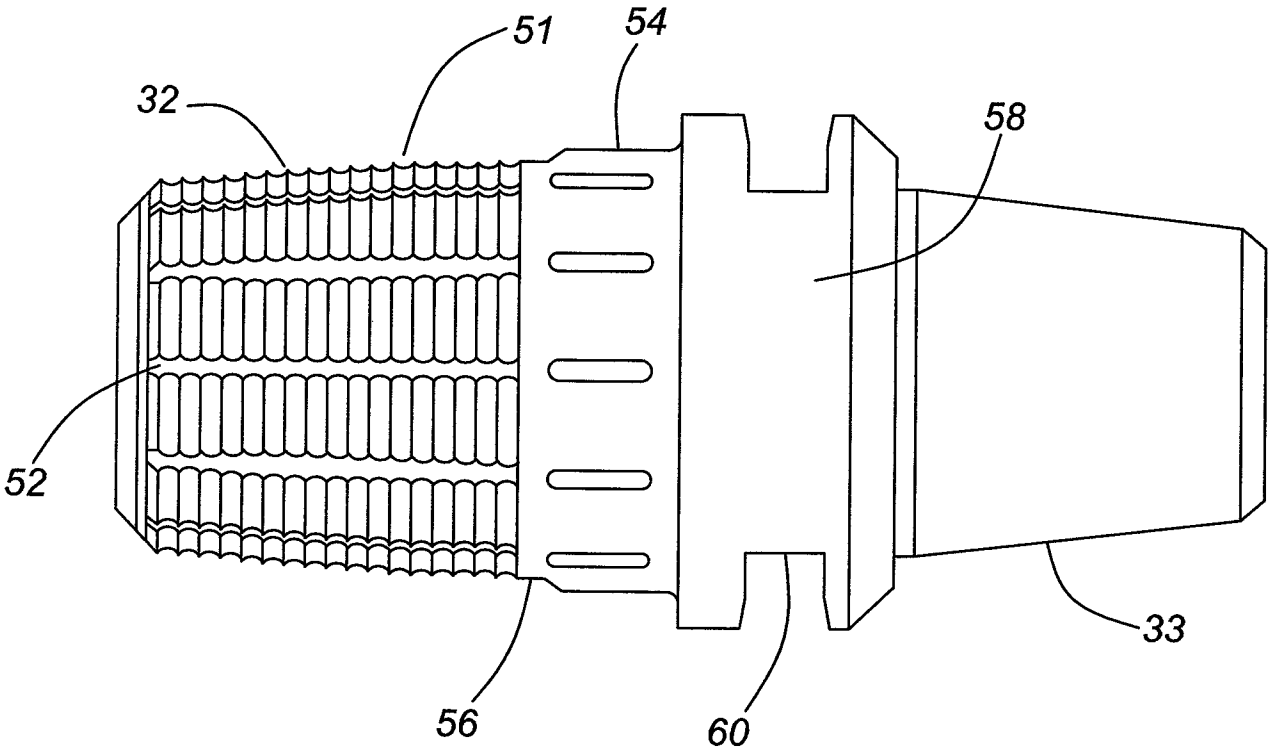
FIG. 3 is a side elevation view of the double pin body.

FIG. 1 illustrates a wellsite system in which a drill string 12 having a drill bit assembly 15 according to one embodiment of the invention can be employed. The wellsite can be onshore or offshore. This exemplary system depicts a vertical well but the invention is also applicable for horizontal well drilling. In FIG. 1 a borehole 11 is formed in subsurface formations by rotary drilling in a manner that is well known. Embodiments of the invention can also use directional drilling, as will be described hereinafter.

The drill string 12 is suspended within the borehole 11 and has a bottom hole assembly 1 which includes the drill bit assembly 15 at its lower end. The bottom hole assembly 1 of the illustrated embodiment comprises a measuring-while-drilling (MWD) module 13, a logging-while-drilling (LWD) module 14, a drill bit assembly 15, and a roto-steerable system and motor 17. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string 12 relative to the hook 18. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit assembly 15, and then circulates upwardly through the annulus region between the outside of the drill string and the wall of the borehole, as indicated by the directional arrows 9. In this well known manner, the drilling fluid lubricates the drill bit assembly 15 and carries formation cuttings up to the surface as it is returned to the pit 27 for recirculation.

The bottom hole assembly (BHA) 1 of the illustrated embodiment comprises a logging-while-drilling (LWD) module 14, a measuring-while-drilling (MWD) module 13, a roto-steerable system and motor 17, and the drill bit assembly 15.

The LWD module 14 is housed in a special type of drill collar, as is known in the art, and can contain one or a plurality of known types of logging tools. It will also be understood that more than one LWD and/or MWD module can be employed, e.g. as represented at 14A. (References, throughout, to a module at the position of 14 can alternatively mean a module at the position of 14A as well.) The LWD module may include capabilities for measuring, processing, and storing information, as well as for communicating with the surface equipment. In the present embodiment, the LWD module includes a pressure measuring device.

The MWD module 13 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module may include one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling". In this embodiment, a roto-steerable subsystem 17 (FIG. 1) is provided. Directional drilling is the intentional deviation of the wellbore from the path it would naturally take. In other words, directional drilling is the steering of the drill string so that it travels in a desired direction. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference. In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Drill Bit Assembly

In each of the embodiments described and shown in FIGS. 1 to 13, the drill bit assembly 15 has a bit head 30 and a mating double pin body 32 with a thermoplastic electrically isolating gap joint 34 having anti-rotation barriers 40 (see FIG. 7) in between the mating portions of the bit head 30 and the double pin body 32. The drill bit assembly 15 is assembled using the thermoplastic gap joint 34 such that the pin body 32 can be precisely and selectively aligned with the bit head 30. Additionally, the anti-rotation barriers 40 provided by thermoplastic material eliminate the need for a separate circumferential weld between the bit head 30 and the pin body 32, or between the pin body 32 and a locking ring (not shown) locked to the bit head 30 as found in some types of matrix heads. Also, the thermoplastic material provides a seal between the pin body 32 and bit head 30 and keeps higher internal (bore) pressure from escaping through the lower pressure exterior (annulus) in the drill bit assembly 15. Likewise, in applications requiring an electrically insulating gap joint, the thermoplastic material 34 has electrically insulating properties, is also impermeable to fluid and maintains its electrical resistance under high hydrostatic pressures, thereby preventing conductive fluid from shorting across the small thread gap between the pin body and bit head 32, 30. In some embodiments, an electronics housing is provided in the pin body or in the bit head. The electronics housing houses electronics equipment comprising reservoir formation measurement equipment and an electromagnetic (EM) transceiver equipment which use a conductor that extends from the electronics housing across the gap joint 34 to contact a conductive part of the drill bit assembly 15 on the other side of the gap joint 34.

A first embodiment of the drill bit assembly 15 is shown in detail in FIGS. 2 to 5. The bit head 30 in this embodiment is a matrix head with a crown with a cutting end and a tubular portion terminating at an opposite pin engagement end. A female threaded axial bore 35 (see FIG. 4) extends from the pin engagement end part way into the body of the bit head 30. The axial bore 35 has an annular lip part way between the end of the bore and the pin engagement end, which abuts against the rim of a gap joint end of the double pin body 32. The bit head 30 has a one piece body made of tungsten carbide in a manner that is well known in the art. Alternatively, the bit head can include a steel locking ring which mechanically engages the bit head with keys that extend into matching keyholes in the bit head (not shown). The locking ring can then be welded to the pin body. An example of such a drill bit assembly having a locking ring are those manufactured by Lyng Drilling. In yet another alternative, the bit head 30 can have a two piece body comprising a tungsten carbide crown brazed onto a steel tubular body with a female threaded axial bore (not shown).

The cutting end of the bit head 30 has a plurality of blades 36. Attached to each blade 36 are a plurality of cutting elements 38; suitable cutting elements include those made from polycrystalline diamond compact (PDC), cubic boron nitride, or other super hard materials as is known in the art. The bit head 30 also has a plurality of drilling fluid discharge ports 42 which extend from the end of the axial bore 35 to the exterior surface of the cutting end of the bit head 30. The axial bore 35 has a portion which tapers inwards and has female threads 46, ("female threaded section"). A plurality of parallel slots or grooves 48 extend in an axial direction through the threads 46 and serve to form anti-rotation barriers as will be described in more detail below. The grooves 48 are milled into the threads 46 and are spaced around the circumference of the threaded section.

While a matrix head is shown as the bit head 30 in this embodiment, other types of bit heads can be substituted, such as a tri-cone bit head (not shown).

The double pin body 32 is made of a 4130 high strength steel alloy but can alternatively be made of any suitable material as known in the art. The double pin body 32 has a generally tubular body with two connecting pin ends each tapering inwards, namely: a gap joint pin end 49 for engagement with the bit head 30, and an API pin end 33 for engagement with the rest of the bottom hole assembly 1. The gap joint pin end 49 has a rim which abuts against the annular lip of the bit head axial bore 35. An axial bore 50 extends through the pin body 32 to allow drilling fluid to flow therethrough and to the ports 42 of the bit head 30. The gap joint pin end 49 has a tapered and rounded coarse male threaded section with threads 51 that match the female threads 46 of the bit head 30. A plurality of parallel slots or grooves 52 extend in an axial direction through the threads 51 and serve to form the thermoplastic anti-rotation barriers 40. The grooves 52 are milled into the threads 51 and are spaced around the circumference of the threaded section. The male threaded section extends from the gap joint pin end to an annular recess 54; an annular, large root stress relief radius 56 bridges the annular recess 54 and threaded section and serves to reduce stress concentrations between the mating components and the thermoplastic gap joint 34 and allows for more even flow of the thermoplastic during injection, as will be described in further detail below. The annular recess abuts against a rim 58, which serves to contain the thermoplastic material 34 in the recess and contain a bit breaker slot 60.

The elongated grooves 48, 52 are machined into the male and female threads 46, 51 and provide cavities for thermoplastic material to fill and form the anti-rotation barriers 40. As will be described in more detail below, anti-rotation, i.e. torsion resistance, is provided by means which require parts of the thermoplastic anti-rotation barrier 40 to shear in order to disassemble the pin body 32 and bit head 30 under torsion loading. The grooves 48, 52 can be but do not have to be aligned when the bit head 30 and pin body 32 are connected.

Figure 4:
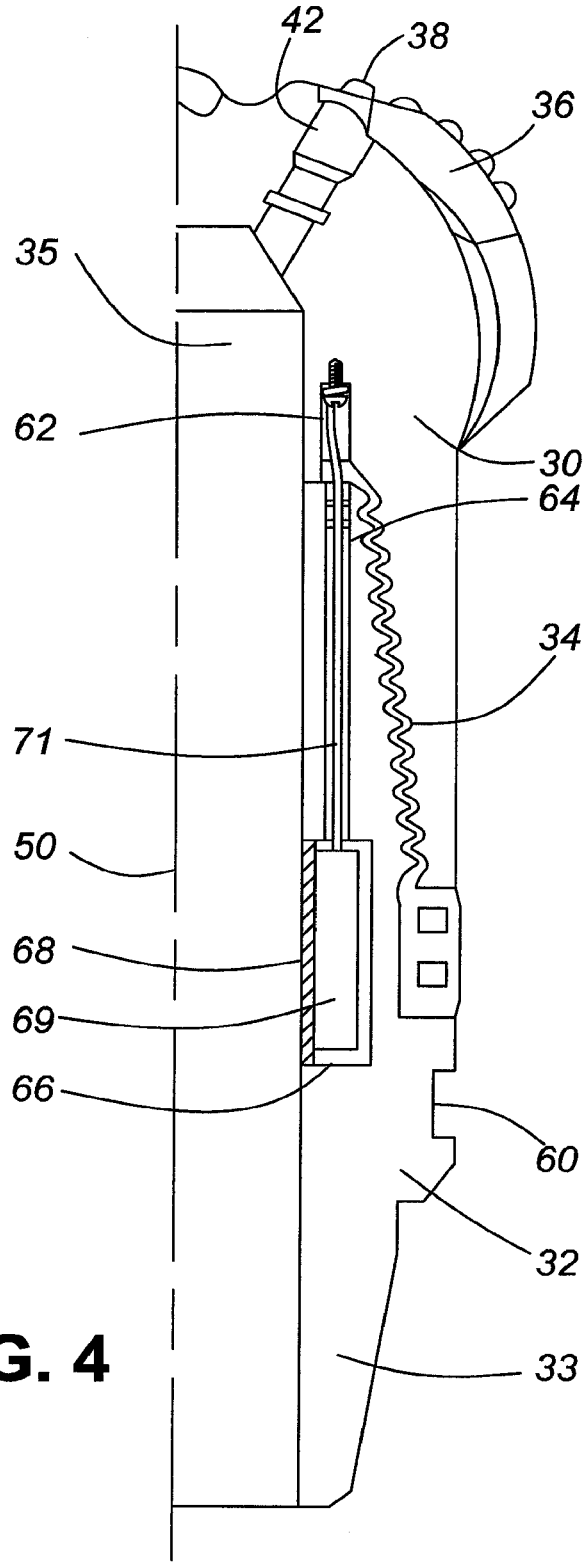
FIG. 4 is a cross-sectional half view of the drill bit assembly with the bit head and double pin body in threaded connection with an electrical isolator gap joint having an anti-rotation barrier in between threads of the bit head and pin.
Figure 5:
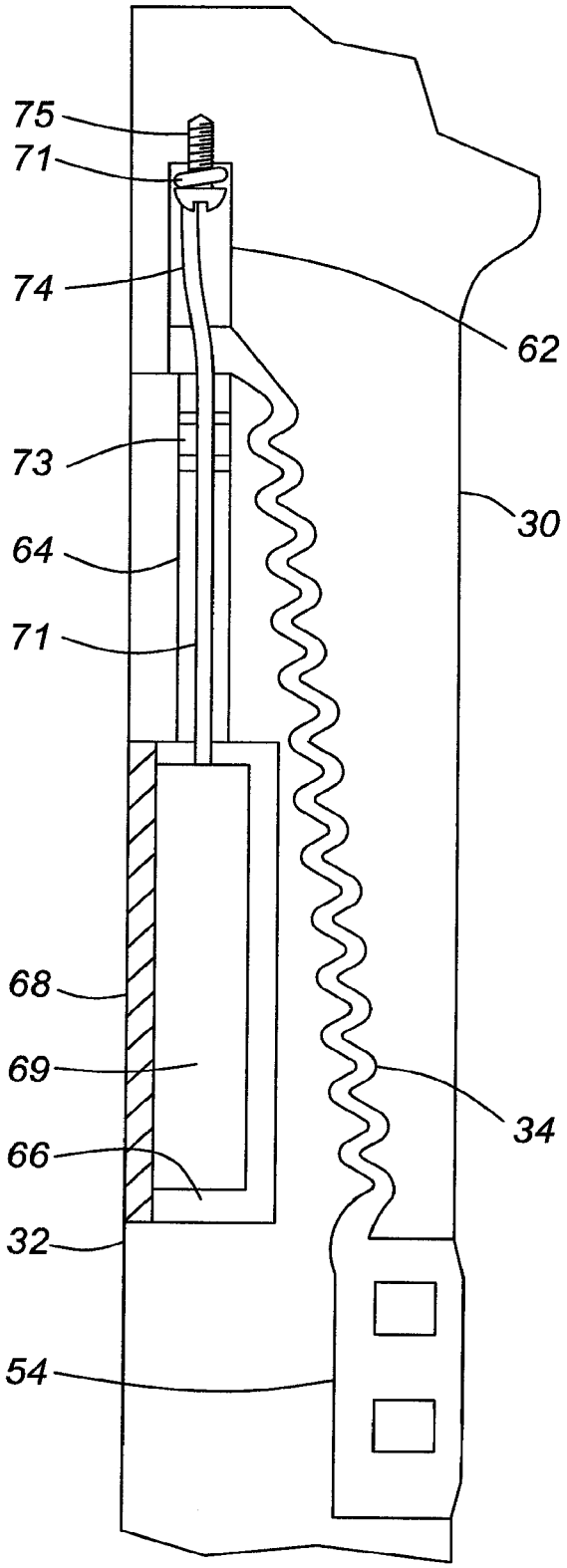
FIG. 5 is a cross-sectional detail view of EM telemetry equipment located in the pin body with a conductor extending through the electrical isolator gap joint into the bit head.

Referring to FIGS. 4 and 5, the drill bit assembly 15 can be provided with a feature such as a communications port 62 in the bit head 30 which connects to or is communicative with a feature such as a communications port 64 in the pin body 32. The pin body communications port 64 is located in the annular portion of the pin body 32, and has one end in communication with an annular electronics housing 66 and another end in communication with the rim of the gap joint pin end, i.e. faces the pin engagement end of the bit head 30. The electronic housing 66 is accessed by a cover 68 in the axial bore 50 of pin body 32. The bit head communications port 62 is a cavity with a mouth that opens into the annular lip of the axial bore 35 and faces the rim of the gap joint pin end.

Alternatively, the features could be used to position sensory housings, such as a gamma module, or electronic support bays. In essence these alignment features can be utilized as spaces for locating electronics as well as sensory packages. Alternately, these could be used as anti-rotation features as well—by the placement of pins through the threads.

Referring to FIG. 5, the electronics housing 66 contains batteries, sensors, microprocessor, and electronics sufficient to measure resistivity and other downhole parameters (collectively, "electronics equipment 69"). The electronics equipment 69 includes an EM transceiver which comprises a transmitter that produces an EM transmission signal consisting of an alternating voltage or a frequency or phase modulated alternating current applied to a conductor end of a transmission wire 71 having a conductive jacket, and a receiver for receiving an EM telemetry signal from the MWD module 13.

The transmission wire 71 extends through the pin body communications port 64 and is potted to support it against vibration damage. One end of the transmission wire 71 is electrically connected, through the use of solder, crimp, or similar technique, to one end of a feed-through conductor of a feed-through 73. The feed-through 73 is seated in the mouth of the pin body communications port 64 that opens into the gap between the pin body 32 and bit head 30. A feed-through is a well known and commercially available part from a supplier such as Greene Tweed, Inc. and consists of an insulating body, seals surrounding the body and providing a seal between the body and the pin body communications port 64, and the conductor seated within a bore in the body. The purpose of the feed-through 73 is to provide a means of passing an electrical conductor through a sealed insulator.

The bit head and pin body communications ports 62, 64 must be precisely aligned with each other in order to allow the passing of wiring therethrough. In particular, wiring 74 is electrically coupled at one end to a second end of the feed-through 73 in a similar manner to the transmission wire 71 and extends through the gap joint 34 and into the bit head communications port 62. The other end of the wiring 74 extends inside the bit head communications port 62 and is anchored to and makes electrical contact solely with the bit head 30 through the use of a securing bolt 75 threaded into the body of the bit head 30.

Alternatively but not shown, an electronics equipment housing can be provided in the bit head 30 instead of or in addition to the pin body 30 in which case the feed through 73 is located in the bit head communications port 62 and the wiring 74 extends from the feed through across the gap joint 34 and into the pin body communications port 64 wherein it is secured to the pin body 32 by a securing bolt.

The bit head and pin body communications ports 62, 64 are aligned with each other by using an assembly method that does not require a conventional application of torque by a make-up machine, and instead involves fixing the pin body 32 and bit head 30 at a selected alignment to each other using an injection molding machine (not shown), then injecting a high-strength, non-porous thermoplastic material 34 at a high temperature in between the mating portions of the pin body 32 and bit head 30 and allowing the thermoplastic material 34 to set under pressure, thereby fixing the pin body 32 and bit head 30 relative to each other in the aligned position.

The thermoplastic material 34 is injected under high pressure into the interstitial space between the equidistant male and female threads of the pin and bit head threaded sections. The injected thermoplastic fills the barrier forming grooves 48, 52 in the pin and bit head 30, 32 to form the anti-rotation barriers 40, and between the conductive component threads to electrically isolate the conductive pin body 32 and bit head 30 from each other. Many different suitable thermoplastic materials may be chosen depending on the properties required. In this embodiment, a particularly suitable thermoplastic material is a resin/fiber composition comprising a liquid crystal polymer (LCP) resin sold under the trade-name Zenite 7130 by DuPont. This material offers high toughness, stiffness, chemical resistance, and creep resistance at high temperature. The resin is further reinforced by the addition of 30% glass fiber. This thermoplastic material 34 is especially suitable as it has low mould shrinkage and low viscosity, especially under high processing stresses. The low viscosity allows the thermoplastic to fill close fitting serpentine paths, such as that formed by overlapping threads. The low shrinkage prevents the thermoplastic from shrinking too much during cooling and creating a poor seal. The thermoplastic is also has dielectric properties, i.e. has negligible electrical conductivity. In another embodiment of the invention rods of insulating material such as fiberglass or Zenite can be inserted in the grooves formed by barrier forming grooves 48, 52 before injecting the thermoplastic. These may serve as centralizers keeping bores 35, and 50 symmetric relative to each other.

Connecting the bit head 30 to the pin body 32 such that the communication ports 62, 64 in each respective component are precisely aligned will now be described.

First, the electronics equipment 69 is installed into the housing 66 and the transmission wire 71 is connected to the feed-through 73. Then, wiring 74 is connected to the feed-through 73 so that the wiring extends out of the mouth of the pin body communications port 64. Then, the drill bit assembly 15 is assembled by loosely screwing the threaded ends of the bit head and pin body 30, 32 together in an axially symmetric arrangement on a mandrel (not shown) which extends through the bores 35, 50 of the pin body and bit head so that the ports 62, 64 in the bit head 30 and pin body 32 are precisely aligned. The mandrel also secures the pin body 32 and bit head 30 in place with a gap between the engagement sections of these two parts, and also serves to prevent thermoplastic material from spilling into the bores 35, 50. The wiring 74 is threaded into the bit head communications port 62 and fastened to the securing bolt 75, which is then screwed into a drill hole in the bit head communications port 62. The transmission wire 71, feed-through 73 and wiring 74 form one continuously extending electrical conductor and serves as the conductor for the EM telemetry equipment; this conductor can also serve to conduct current for measurement equipment taking resistivity measurements as will be discussed below.

Alternatively, the wiring 74 can be first secured to the securing bolt 75, then connected to the feed through 73. As another alternative, the feed-through 73, wiring 74, and transmission wire 71 is replaced by a single continuous conductor which extends from the securing bolt 75 to the electronics equipment 69.

Then, the threaded connecting ends of the bit head and pin 30, 32 are fixed in a mold of an injection molding machine (not shown) such that the tapered threads overlap but do not touch and the bit head and pin body communications ports 62, 64 remain precisely aligned. Such injection molding machine and its use to inject thermoplastic material into a mold is well known the art and thus are not described in detail here. The mold is designed to accommodate the dimensions of the loosely screwed together drill bit assembly 15 in a manner that the thermoplastic injected by the injection molding machine is constrained to fill the gaps in between the threads. Optionally, the assembly 15 can be evacuated first before injecting the thermoplastic.

Then, the thermoplastic material is heated to between 363° C. and 371° C. and preferably about 370° C. until the thermoplastic is in liquid form, and then is injected ("injectant") into an equidistant gap formed between the threads of the bit head and pin body 30, 32 until the bores 35, 50 are physically separated by thermoplastic material, into the barrier forming grooves 48, 52 and into the annular recess 54 circumscribing the pin body 32 up to but not spilling over edge of the rim 58. During this process, the thermoplastic material will cover the wiring 74, which is exposed between the communication ports 62, 64. Wear rings 76 surrounding the recess 54 can be embedded in the thermoplastic material to protect the seal against wear. The mold temperature, thermoplastic temperature, flow rate, and pressure required to beneficially flow the injectant and completely fill these spaces are selected in the manner as known in the art. The mold and bit head 30 and pin body 32 are also heated, to about 150° C. so that these parts do not cause the thermoplastics to cool too quickly and solidify prematurely and not completely fill the gap. Once filled, a holding pressure (typically ~16,000 to 18,000 psi) is maintained until the thermoplastic injectant cools and solidifies and the thermoplastic gap joint 34 with sealing anti-rotation barriers 40 is formed.

The pin body 32 and bit head 30 can be provided with elongated grooves through the threads (not shown). The thermoplastic material will fill these grooves and form anti-rotation barriers protruding from the gap joint, and impeding the pin body 32 from rotating relative to the bit head 30.

After the thermoplastic material solidifies and become mechanically rigid or set, formation of the thermoplastic gap joint 34 with sealing and anti-rotation barriers 40 is complete and the bit head 30 and pin body 32 can be removed from the injection molding machine. The thermoplastic gap joint 34 now firmly holds the bit head 30 and pin body 32 together mechanically, yet separates the bit head 30 and pin body 32 electrically. The thermoplastic gap joint 34 also provides an effective drilling fluid barrier between the inside and outside of the drill bit assembly 15. Also, this injection process enables the bit head and pin body communication ports 62, 64 in the bit head 30 and pin body 32 to be precisely aligned, which cannot be done by a make-up machine.

The thermoplastic gap joint 34 is generally annular, having an annular outer rim which fills the recess 54, an annular inner rim which separates the axial bores 35, 50 of the bit head 30 and pin body 32, and an annular undulating interconnect portion interconnecting the outer and inner rims. The outer and inner end rims are respectively exposed on the outer and inner surfaces of the drill bit assembly 15 with sufficient distance between the bit head and pin 30, 32 to provide the electrical isolation necessary for the drill bit assembly to serve as an EM telemetry emitter for example.

By using an electrically insulated gap integral to the drill bit, resistivity and other measurements can be taken at the drill bit location rather than at a greater distance back in the LWD module of the bottom hole assembly 1. This is particularly advantageous as there would be an immediate indication of formation penetration since all water-bearing rock formations conduct some electricity (lower measured resistivity), and hydrocarbon-bearing rock formation conduct very little electricity (higher measured resistivity). Greater accuracy can be achieved by knowing the formation resistivity at the face; this ensures that proper corrective responses can be taken to maintain borehole placement in the pay-zone while directional drilling. Further, real-time data can be provided allowing for quicker drilling as the lag-time typically experienced in determining formation penetration would be reduced.

By providing the electrically insulating gap joint 34 in the drill bit assembly 15, it may not be necessary to use a secondary telemetry tool in the drill string 12 such as the MWD module 13, as the gap joint 34 combined with the appropriate electronics equipment and power supply 69 could be used for EM telemetry with the surface. In doing so, the length of the drill string 12 can be shortened as the functionality provided by the MWD module 13 is provided in the drill bit assembly 15. Conversely, the gap joint 34 could be used as a means of communication between one or more telemetry device(s) further up the drill string 12 (a short hop) such as the MWD module 13, acting as a relay for data gathered at the face (all the measuring devices located below the motor for example).

Figure 6A:
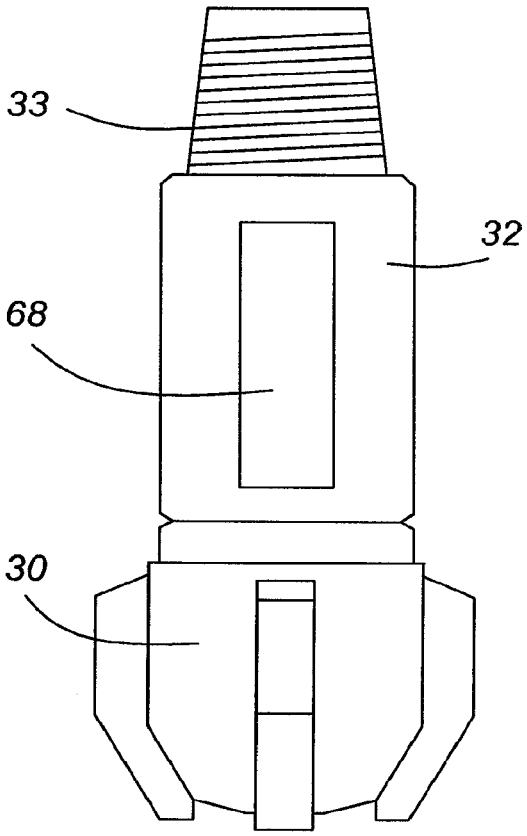
FIGS. 6(*a*) and (*b*) are schematic exterior and sectional elevations views of the drill bit assembly having an annular pin body with an electronics housing in the body according to a second embodiment.
Figure 6B:
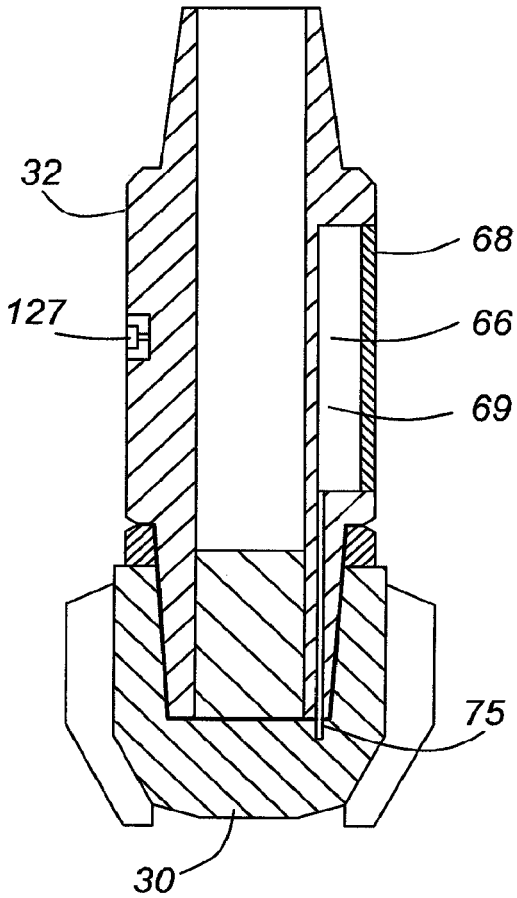

In an alternative embodiment as shown in FIGS. 6(*a*) and (*b*), the gap joint pin end of the pin body 32 abuts directly against the end of the axial bore 35 of the bit head 30, and the securing bolt 75 does not have to be recessed in the bit head communications port 62 and instead is secured to the end the bit head axial bore 35 (or to the annular rim of the axial bore 35 as shown in FIGS. 2 to 5). While the securing bolt 75 is more exposed, this alternative embodiment eliminates the need to precisely align the bit head and pin body communications ports 62, 64; after the pin body 32 and bit head 30 are fastened in the injection molding machine, a drill can be inserted into the electronics housing 66 and though pin body port 64 and a drill hole can be drilled into the annular lip of the axial bore 35. Then, the bolt 75 can be secured through this drill hole.

The embodiment shown in FIGS. 6(*a*) and (*b*) also differs in having the electronics housing 66 located beyond the threads 46 such that the housing 66 opens into the exterior surface of the pin body 32 and the cover 68 is located on the pin body exterior surface. While this design may extend the length of the pin body 32, it makes for easier access to the electronics housing 66. Sensors (not shown) such as inclinometers, accelerometers, magnetometers, or temperature sensors can be mounted in the housing 66. External sensors, such as electrodes 127, can also be implemented in the drill bit assembly 15.

Anti-Rotation Barriers

As is well known in the art, the tapered coarse threads in this application efficiently carry both axial and bending loads, and the interlock between the threads provides added mechanical integrity should the thermoplastic gap joint 34 be compromised for any reason. The thermoplastic gap joint 34 provides an arrangement that is self-sealing since the thermoplastic gap joint 34 is nonporous, free from cracks or other defects that could cause leakage, and was injected and allowed to set under high pressure. As a result, drilling fluids cannot penetrate through the thermoplastic material and cannot seep along the boundary between the thermoplastic gap joint 34 and the surfaces of the bit head and pin 30, 32. Thus no additional components are necessary to seal this assembly.

In one embodiment, a certain amount of torsion resistance is provided by the high normal force between the thermoplastic gap joint 34 and the threads of the pin body 32 and bit head 30 resulting from the high injection pressure of the thermoplastic into the interstitial cavity. This high normal force in turn provides high frictional force resisting movement of the threads. Enhanced torsion resistance is achieved by elongated barriers 40 which are formed by injecting thermoplastic material into grooves 48, 52 in the surfaces of the male and female threaded sections of the pin and bit head 32, 30 respectively. The grooves 52 in the male threaded section of the pin body 32 prevents the thermoplastic material therein 40 from rotating with respect to the pin body 32. Similarly, the grooves 48 in the female threaded section of the bit head 30 prevents the thermoplastic material therein (not shown) from rotating with respect to the bit head 30. Grooves in both the male and female sections of the bit head and pin 30, 32 are preferred to provide enhanced torsion resistance with there being no need for the grooves to be proximately aligned.

Figure 7:
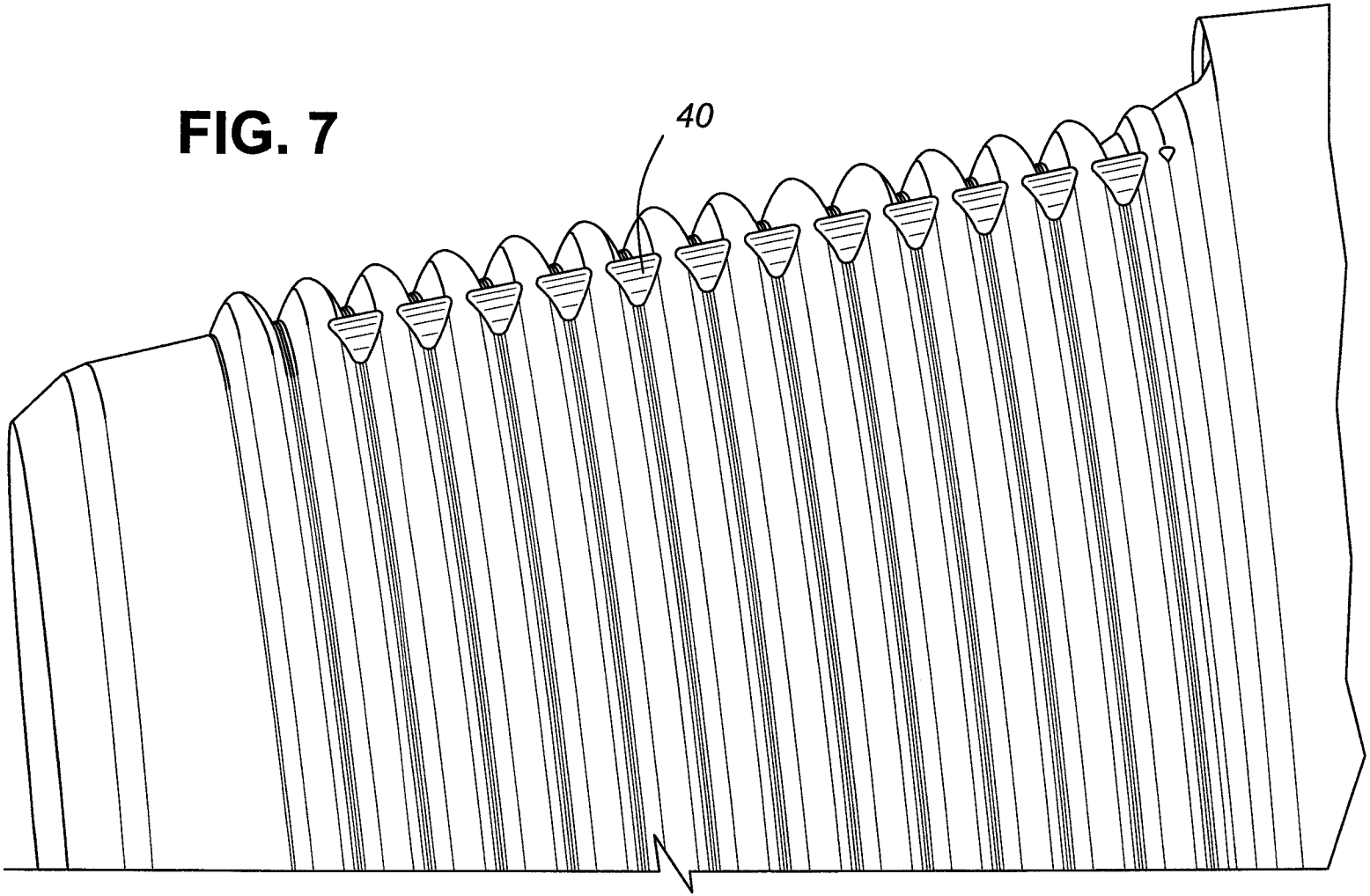
FIG. 7 is a perspective view of a male-threaded engagement section of the pin body having coated thereon the electrical isolator gap joint having an anti-rotational barrier produced by an elongated groove machined into the threads of a female threaded engagement section of the bit head.

As shown in FIG. 7, each barrier 40 extends longitudinally along the threaded section of the pin body 32. The barrier 40 shown in FIG. 7 has been formed by injecting thermoplastic material into the grooves 48 in the female threaded section of the bit head 30. Segments of the barrier 40 are shaded in this figure to better illustrate the portions of thermoplastic material that must be sheared in order to decouple the connection between the male and female sections of the bit head 30 and pin body 32. These segments are herein referred to as anti-rotation segments. In this embodiment, the first barrier 40 provides shear resistance against the female threads, and a second barrier (not shown) is provided which provides shear resistance against the male threads. In an alternative embodiment, only a single barrier is provided, proximate to either the male or female threads, providing some torsion resistance. However, it is clear that having a barrier preventing rotation of both male and female threads with respect to the dielectric material provides better torsion resistance than a single barrier. This is because the threads which do not have a barrier will be easier to unscrew than the threads which incorporate a barrier. While multiple barriers extending into grooves 48, 52 of both the male and female threaded sections are shown in these Figures, anti-rotation resistance can alternatively be provided with just two barriers 40, one extending into one groove 48 in the female threaded section, and one extending into one groove 52 in the male threaded section.

Figure 8:
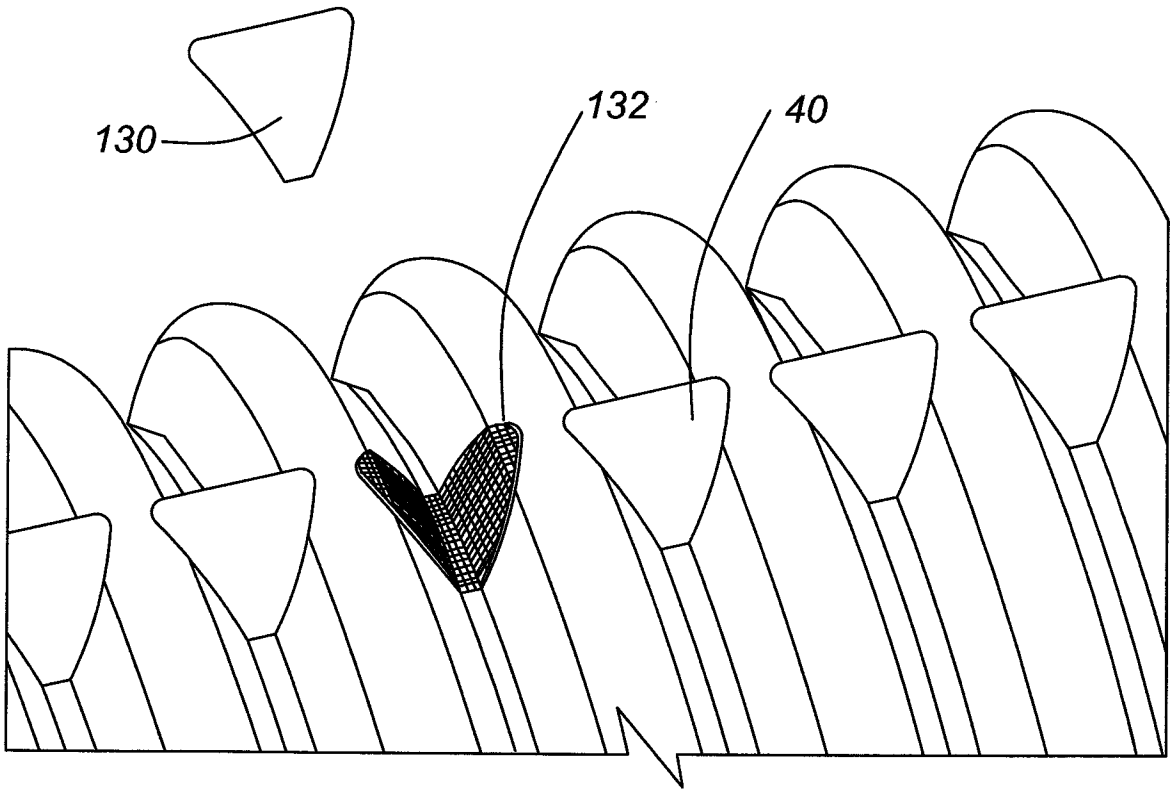
FIG. 8 is a perspective view showing one anti-rotation segment shearing away from the remainder of the barrier.

FIG. 8 illustrates what must happen for the female threads to uncouple from the thermoplastic gap joint 34. All segments 130 must shear away from the remainder of the thermoplastic material (for clarity, only one sheared segment 130 is shown).

The crosshatched pattern 132 shows the 'shear area' of one anti-rotation segment 130. Varying the depth of the grooves 48, 52 will affect the shear area of each segment. The torsion resistance of each individual segment is determined by multiplying the shear area with the shear strength of the thermoplastic material and the moment arm, or distance from the center axis, as the following equation denotes:

$$T_i = A_i S D_i$$

where:

$T_i$ is the torsion resistance of an individual anti-rotation segment, $A_i$ is the area of thermoplastic material loaded in pure shear, S is the shear strength of the thermoplastic material, and $D_i$ is the segment moment arm or distance from the center axis.

The male threaded section of the pin body 32 has multiple parallel anti-rotation grooves 48 spaced around the pin body 32 that create a thermoplastic gap joint 34 having multiple barriers (not shown) against the male threads. Multiple barriers provide additional shear resistance over a single barrier. In this embodiment, corresponding grooves 52 (see FIG. 2) are found in the female threaded section of the bit head 30 to provide multiple barriers against the female threads. Torsion resistance between the thermoplastic gap joint 34 and the male threaded section of the pin body 32 (or the thermoplastic gap joint 34 and the female threaded section of the bit head 30) is determined by the sum of the resistances provided by each individual segment, as follows:

$$T_M \text{ or } T_F = \sum_{1}^{N_{slot}} \sum_{1}^{N_{seg}} T_i = \sum_{1}^{N_{slot}} \sum_{1}^{N_{seg}} A_i S D_i$$

where:

$T_M$ is the torsion resistance between thermoplastic gap joint 34 and male threaded section of the pin body 32;

$T_F$ is the torsion resistance between thermoplastic component and female threaded section of the bit head 30;

$N_{seg}$ is the number of anti-rotation segments per slot;

$N_{slot}$ is the number of slots in male or female threaded section;

Since rotation of the thermoplastic gap joint 34 with respect to either of bit head and pin 30, 32 would constitute decoupling of the joint, torsion resistance for the entire joint is the lesser of $T_M$ or $T_F$.

As illustrated, the torsion resistance provided by this embodiment is a function of geometry and the shear strength of the material. With the formulae presented and routine empirical testing to confirm material properties, the quantity of anti-rotation segments required to produce any desirable safety margin is easily determined by one skilled in the art.

Alternate Embodiments

Figure 9:
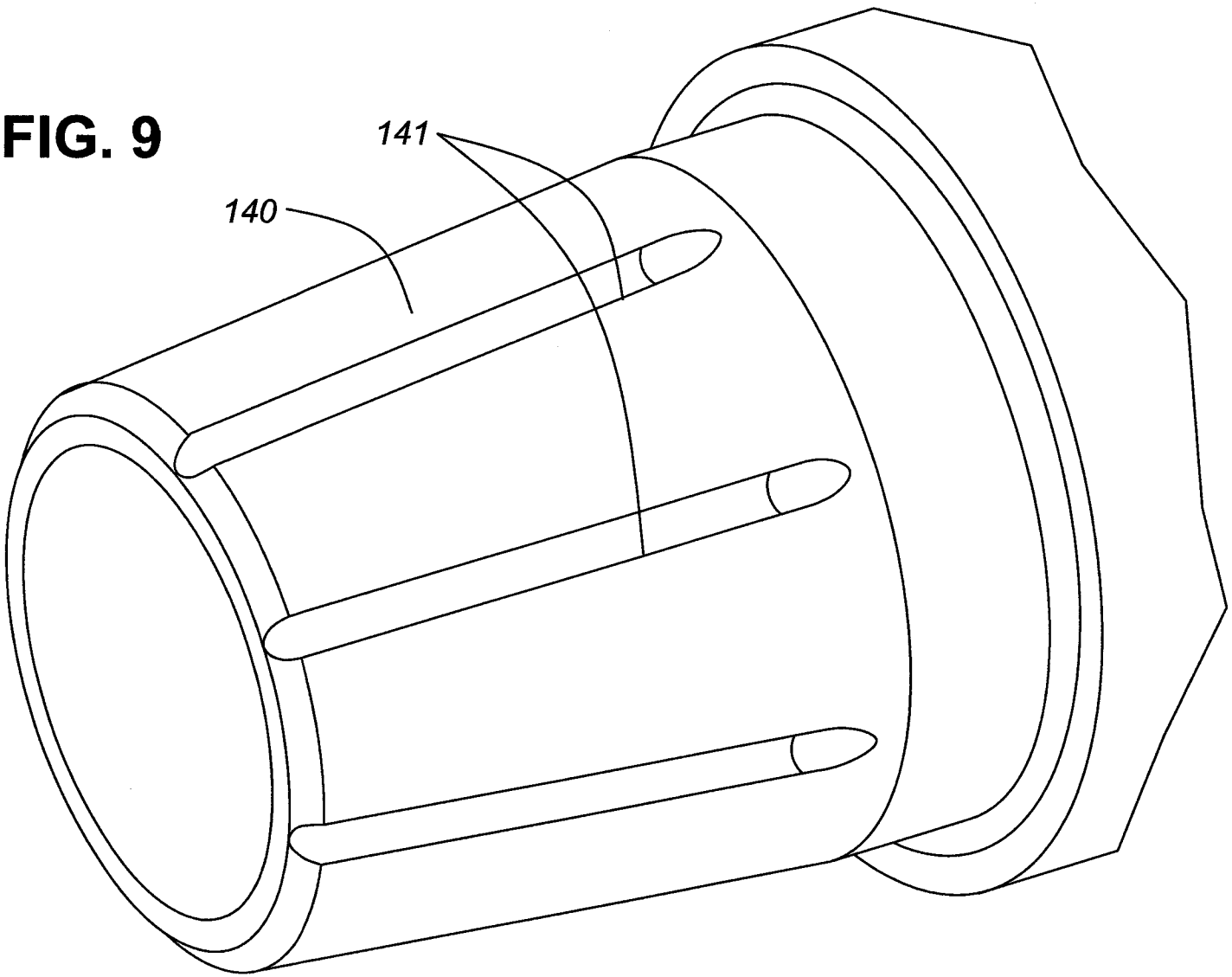
FIG. 9 is a perspective view of a threadless engagement section of the pin body having thereon an elongated groove parallel to the pin axis, for producing an anti-rotation barrier in the electrical isolator component according to an alternative embodiment.

Referring to FIG. 9 and according to another embodiment, a male engagement section 140 of the pin body 32 has a smooth threadless surface having multiple milled straight and parallel grooves 141 spaced around the pin body 32. These grooves 141 create multiple elongated straight thermoplastic material barriers (not shown). Similar straight grooves are found in a female threadless engagement section that creates multiple barriers to rotational movement in the thermoplastic material (not shown) with respect to the bit head 30. The barriers themselves provide torsion resistance, illustrating that a thread form is not required to provide torsion resistance. In the embodiments shown in FIGS. 2 to 6, the thread form is present to primarily resist axial and bending loads, and does not contribute as significantly to torsion resistance.

Figure 10:
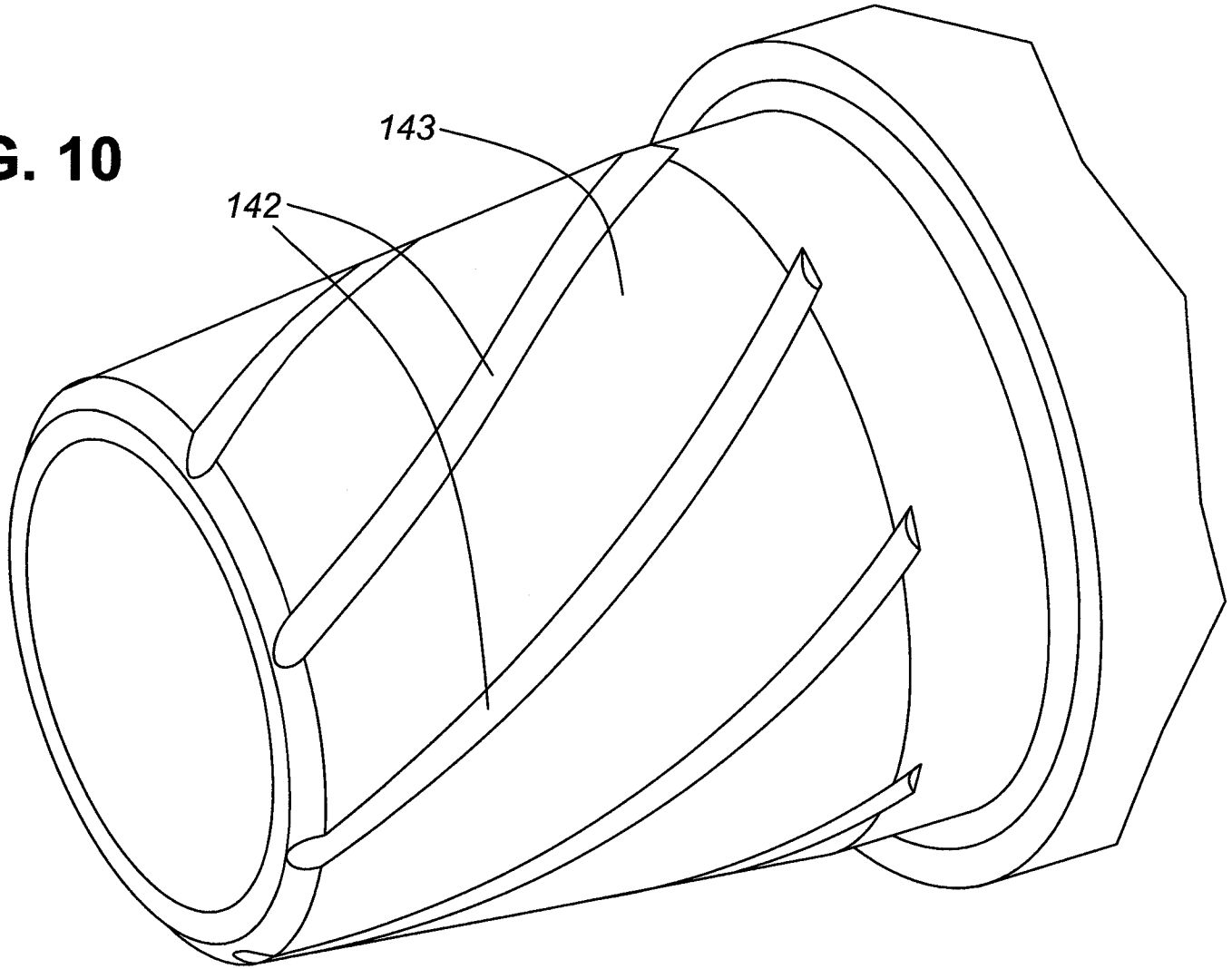
FIG. 10 is a perspective view of a threadless engagement section having thereon multiple grooves spaced side-by-side and non-parallel to the pin body axis for producing multiple anti-rotation barriers in electrical isolator component according to an alternative embodiment.

Referring to FIG. 10 and illustrating another embodiment, a smooth threadless surface 142 is shown that has multiple milled curved grooves 143 that extend at an angle to the axis of the pin body 32. The grooves 143 create curved and angled thermoplastic barriers that provide both axial and torsional resistance against the pin body 32. Similar curved grooves are found in the female engagement section (not shown) of the bit head that serve to create curved and angled barriers (not shown) that provide both axial and torsional resistance against the bit head 30.

Figure 11:
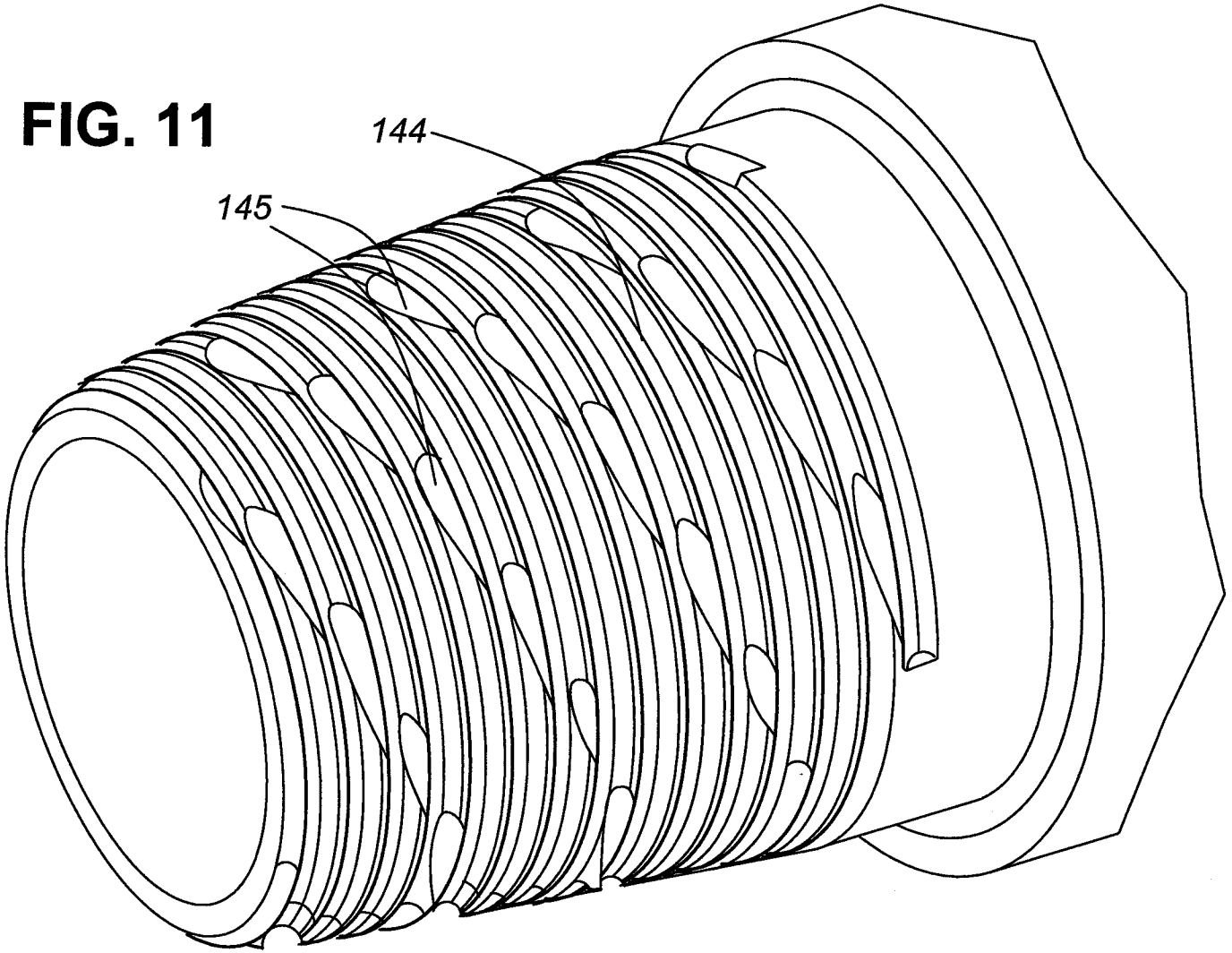
FIG. 11 is a perspective view of a male-threaded engagement section of the pin body having thereon multiple grooves spaced head-to-tail in a reverse threaded pattern for producing multiple anti-rotation barriers in the electrical isolator gap joint according to an alternative embodiment.

Referring to FIG. 11 and illustrating a further embodiment, the threaded surface of the male engagement section 144 of the pin body 32 is provided with curved grooves extending head-to-tail that are fashioned as a reverse thread 145 overlapping the threads of the pin body 32. A similar reverse thread is found in the threaded surface of the complementary female engagement surface (not shown) of the bit head 30. The grooves in both components create curved barriers in a dielectric component (not shown). The torsion resistance provided by these barriers can be adjusted by adjusting the characteristics of the grooves, e.g. the pitch and the number of thread starts and thread profiles.

Figure 12:
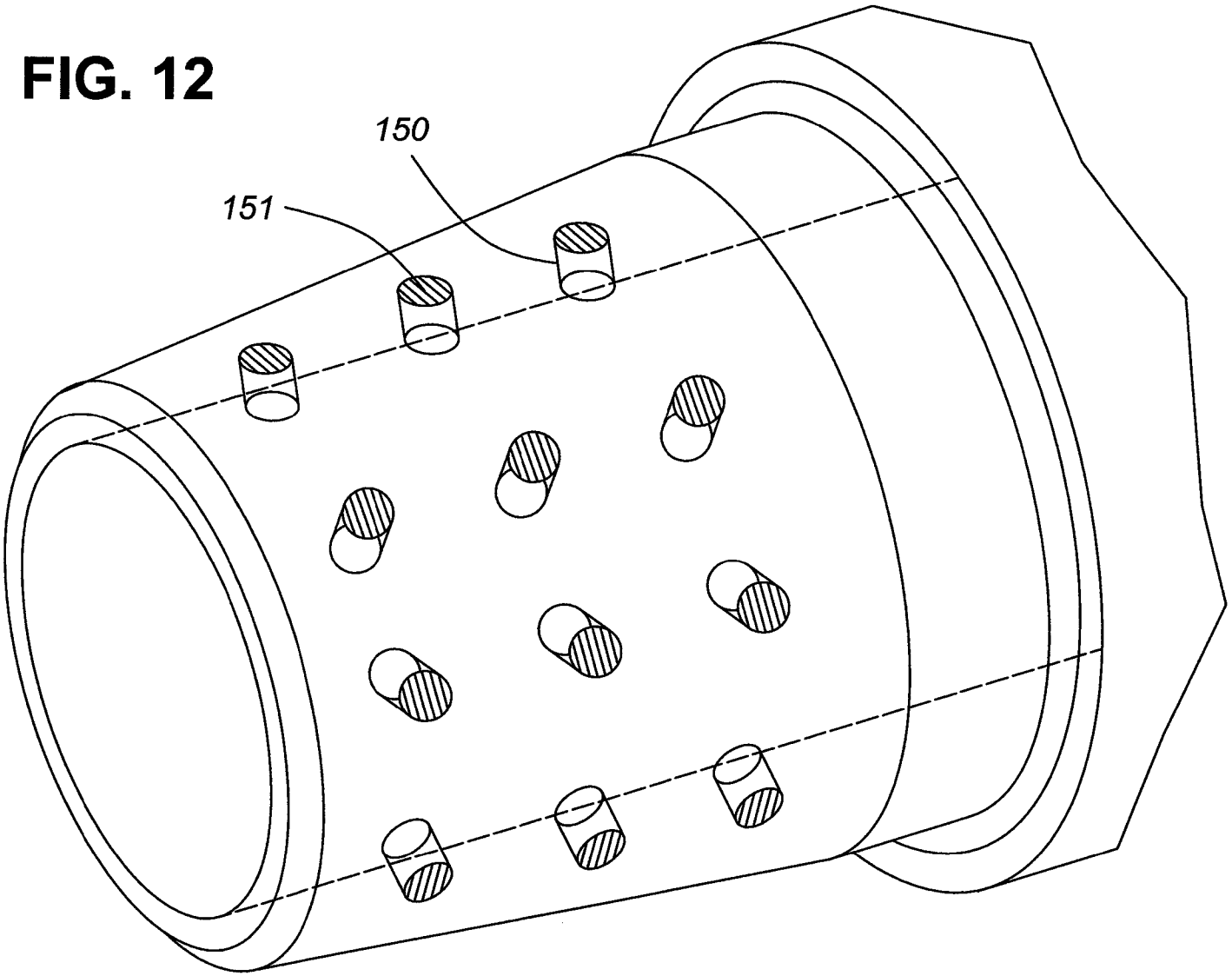
FIG. 12 is a perspective view of a threadless engagement section of the pin body having cylindrical holes spaced along the surface the engagement section for producing multiple anti-rotation barriers in the electrical isolator gap joint according to an alternative embodiment.

Referring to FIG. 12 and illustrating another embodiment, holes 150 are drilled into the surfaces of both male and female engagement sections of the pin and bit head 32, 30 respectively. Although a male engagement section having a smooth threadless surface is shown in this Figure, similar holes can be provided in threaded engagement section. Drill holes 150 serve as molds for creating multiple barriers in the thermoplastic material (not shown). The hatched regions 151 indicate shear areas of the barriers, and the 'hidden' lines 100 illustrate that material remains in the holes after shearing. Although multiple rows of drill holes are shown in this Figure, a different number and layout of holes can be provided within the scope of the invention.

Figure 13:
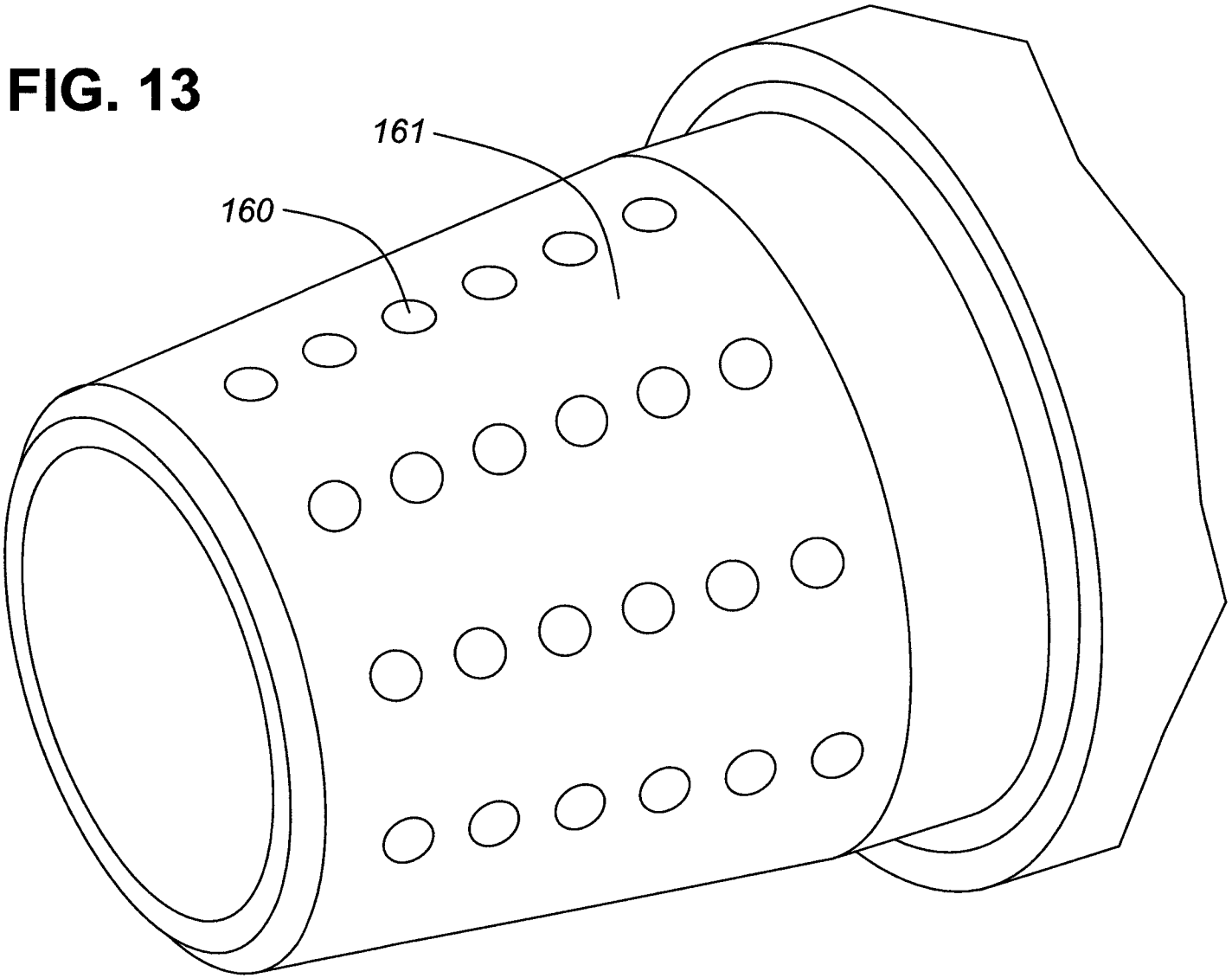
FIG. 13 is a perspective view of a male threadless engagement section of the pin body having dimples spaced along the surface of the engagement section for producing multiple anti-rotation barriers in the electrical isolator gap joint according to an alternative embodiment.

Referring to FIG. 13 and illustrating yet another embodiment, dimples 160 are provided in the surfaces of both male and female engagement sections of the pin and bit head 32, 30 respectively. Although a male engagement section having a smooth threadless surface is shown in this Figure, similar dimples 160 can be provided in a threaded engagement section. Dimples serve as molds for creating multiple barriers in the thermoplastic material (not shown). Such dimples can be fashioned into the material by forms of plastic deformation (e.g. pressed or impacted) or material removal (e.g. grinding, milling, sanding, etc.). Although multiple rows of dimples are shown in this figure a different number and layout of dimples is inferred to be within the scope of the invention.

While FIGS. 12 and 13 illustrate drill holes 150 and dimples 160 for creating torsion resistance barriers in the thermoplastic material 34, recessed portions of other realizable patterns or shapes could be used to create barriers that would be suitable for providing suitable torsion resistance.

Figure 14C:
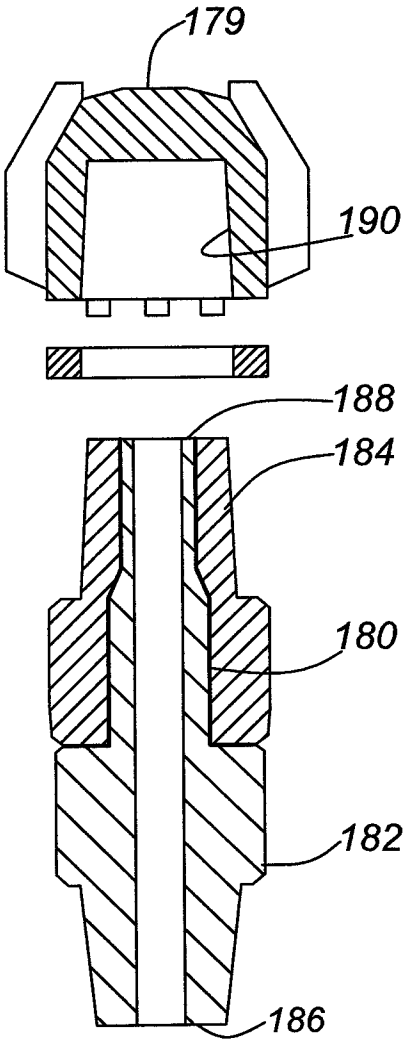
FIGS. 14(*a*) to (*c*) are a schematic exterior assembled and sectioned assembled and dissembled views of a two-piece pin body having an electrically insulating gap joint between two pieces of the pin body according to another embodiment.
Figure 14B:
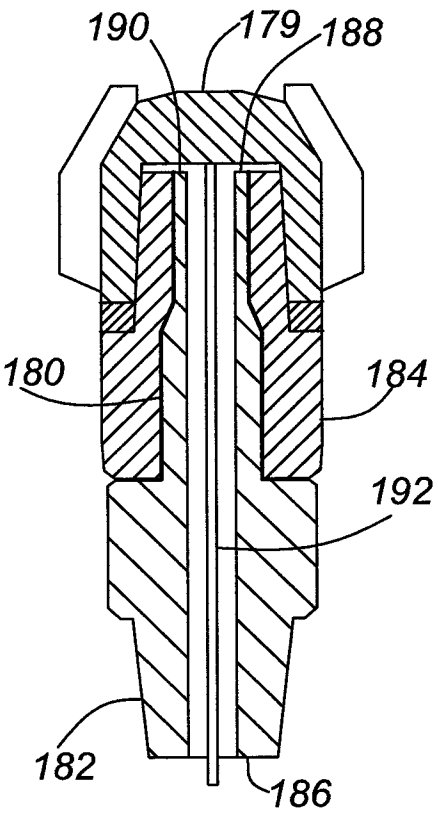
Figure 14A:
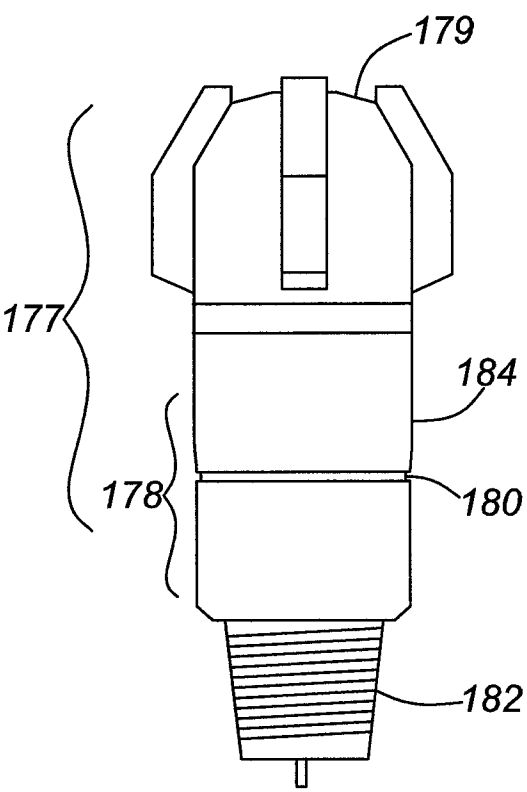

According to another alternative embodiment and referring to FIGS. 14(*a*) to (*c*), a drill bit assembly 177 having a two piece pin body 178 is provided with an insulating gap joint 180 between the engagement sections of the two pieces of the pin body 178. This second insulating gap joint 180 can be provided instead of or in addition to a gap joint (not shown) between the engagement sections of the pin body 178 and the bit head 179. In this alternative embodiment, the pin body 178 has an API pin piece 182 and a bit head pin piece 184. The API pin piece 182 has an API pin end 186 and a male threaded gap joint pin end 188. The bit head 179 has a female threaded bore 190 which mates with the gap joint pin end 188. The male threads on the API pin piece 182 are threaded into female threads on bit head pin piece 184. The threads may have two different diameters to increase the holding strength of this connection. A thermoplastic injection technique as described for forming gap joint 34 can be applied to form the gap joint 180. Cavities or grooves (not shown) can be provided on the surface of one or both of the gap joint pin end 188 and bit head pin piece 184, in which thermoplastic will fill to form anti-rotation barriers (not shown). A conductor 192 can cross the second gap joint 180 and have one end contacting either the pin body 178 or as shown in these Figures, the bit head 179, and the other end in communication with electronics equipment such as EM telemetry circuitry or reservoir formation measurement equipment (not shown). The conductor 192 can extend through aligned ports in the annular portions of the API pin piece 182 and bit head pin piece, or as shown in these Figures, through the axial bore 190 of the pin body 178.

In yet another alternative embodiment, a two piece bit head is provided (not shown) and another insulating gap joint is provided between the two pieces of the bit head. Thermoplastic injection techniques as described above can be applied to form the gap joint. A conductor can be extended across the gap joint to have one end contact one of the bit head pieces and the other end to communicate with electronics equipment.

In yet another embodiment, other materials other than thermoplastic or ceramic can be used to form the gap joints 34, 180. The material can be an epoxy, or another polymer based material. Instead of pressurized injection, the thermoplastic, epoxy and other polymer based materials can fill the gap and barrier-forming cavities by potting, then solidified by curing. Curing can be done at atmospheric pressure, or more preferably under pressure to prevent or minimize the tendency for the material to expand out of the gap. The metal and ceramic can be liquefied then cast into the gap and barrier forming cavities. Casting and potting can be performed at either atmospheric pressure or under a vacuum to gain the benefit of increased face friction between the joint material and the connecting parts. Instead of pouring a liquid ceramic into the gap, a ceramic powder can be applied into the gap then sintered to form the gap joint. Alternatively, a ceramic green compact can be machined to the exact dimensions of the gap (or produce a mold to compress the ceramic powder into a green compact with exact dimensions), and screw the bit head having a ceramic green compact screwed into the compact till the bit head bottoms, then screw the pin body into the compact this till the pin body bottoms. Then the barrier forming cavities would be filled with ceramic powder, the ceramic powder is then sintered to produce the gap and barriers.

While the present invention has been described herein by the preferred embodiments, it will be understood by those skilled in the art that various consistent and now obvious changes may be made and added to the invention. The changes and alternatives are considered within the spirit and scope of the present invention.

What is claimed is:

1. A method of manufacturing a drill bit assembly having a bit head and a pin body, the bit head comprising a cutting end, an opposite connecting end with an engagement section, and a feature within a wall of the bit head and facing the connecting end; and the pin body comprising a tubular body with an axial bore therethrough and comprising a connecting end with an engagement section and a feature within a wall of the tubular body and facing the connecting end; the method comprising:

(a) positioning the pin body connecting end with the bit head connecting end such that the pin body and bit head engagement sections overlap with a gap therebetween, and the pin body and bit head features are aligned;

(b) injecting a connecting material in liquid form between the bit head and pin body engagement sections and into the gap; and (c) solidifying the connecting material such that the bit head and pin body are mechanically coupled together at their connecting ends and their features are securely aligned.

2. A method as claimed in claim 1 wherein the connecting material is a thermoplastic material which is injected into the gap such that the gap is filled, and the thermoplastic material is solidified to form a gap joint in between the pin body and bit head.

3. A method as claimed in claim 2 wherein the bit head comprises a female connecting end and the pin body comprises a male connecting end, and the male connecting end is inserted into the female connecting end when positioning the pin body connecting end with the matrix head connecting end.

4. A method as claimed in claim 2 wherein the thermoplastic material is a dielectric material.

5. A method as claimed 4 wherein the thermoplastic material comprises a liquid crystal polymer resin reinforced by glass fiber.

6. A method as claimed in claim 2 wherein the thermoplastic material is solidified under a holding pressure between 16,000 and 18,300 psi.

7. A method as claimed in claim 1 wherein the drill bit assembly further comprises at least one cavity in at least one of the bit head engagement section and the pin body engagement section, and the method further comprises injecting a thermoplastic material in liquid form between the bit head and pin body engagement sections such that the gap and each cavity are filled, then solidifying the thermoplastic material such that the bit head and pin body are mechanically coupled together at their connecting ends, and a segment of thermoplastic material is formed which protrudes into each cavity.

8. A method as claimed in claim 7 wherein each cavity is an elongated groove extending substantially parallel to an axis of the bit head and pin body and across at least one of the bit head and pin body engagement sections, and the method further comprises injecting the thermoplastic material in liquid form between the bit head and pin body engagement sections such that the gap and the each groove is filled, and solidifying the thermoplastic material such that the bit head and pin body are mechanically coupled together at their connecting ends, and a segment of thermoplastic material is formed and protrudes into each groove.

9. A method as claimed in claim 8 wherein the bit head and pin body engagement sections are threaded with matching threads, and each groove extends across multiple threads, and the method further comprises injecting the thermoplastic material in liquid form between the threads of the bit head and pin body engagement sections.

10. A method as claimed in claim 7 wherein each cavity is an elongated groove extending at an acute angle to an axis of the bit head and pin body and across at least one of the bit head and pin body engagement sections, and the method further comprises injecting the thermoplastic material in liquid form between the bit head and pin body engagement sections such that the gap and each groove are filled, and solidifying the thermoplastic material such that the bit head and pin body are mechanically coupled together at their connecting ends, and a segment of thermoplastic material is formed and protrudes into each groove.

11. A drill bit assembly comprising:

a bit head having a cutting end, an opposite connecting end with an engagement section, and a feature within a wall of the bit head and facing the connecting end;

a pin body having a connecting end with an engagement section and a feature within a wall of the pin body and facing the connecting end, the pin body and bit head connecting ends positioned such that the bit head and pin body engagement sections overlap with a gap therebetween and the bit head and pin body features are aligned; and an injectable gap joint filling the gap such that the bit head and pin body are mechanically coupled together at their connecting ends.

12. A drill bit assembly as claimed in claim 11 further comprising a cavity in at least one of the bit head engagement section and the pin body engagement section; and the gap joint further comprises a segment protruding into each cavity to impede the rotation of the bit head relative to the pin body.

13. A drill bit assembly as claimed in claim 11 wherein the pin body has a male connecting end and the bit head has a female connecting end, and the male connecting end is inserted in the female connecting end such that the bit head and pin body engagement sections overlap.

14. A drill bit assembly as claimed in claim 11 wherein both the bit head and pin body comprise at least one cavity in each of their engagement sections, and the thermoplastic material comprises a first segment that protrudes into a cavity in the bit head engagement section and a second segment that protrudes into a cavity in the pin body engagement section.

15. A drill bit assembly as claimed in claim 11 wherein the thermoplastic material is a dielectric.

16. A drill bit assembly as claimed in claim 15 wherein the thermoplastic material comprises a liquid crystal polymer resin reinforced by glass fiber.

17. A drill bit assembly as claimed in claim 11 wherein each cavity is an elongated groove extending substantially parallel to an axis of the bit head and pin body and across at least one of the bit head and pin body engagement sections.

18. A drill bit assembly as claimed in claim 17 wherein the bit head and pin body engagement sections are threaded with matching threads, and each groove extends across multiple threads, and the thermoplastic material is located between and around the matching threads.

19. A drill bit assembly as claimed in claim 11 wherein each cavity is an elongated groove extending at an acute angle to an axis of the bit head and pin body and across at least one of the bit head and pin body engagement sections.

20. A drill bit assembly as claimed in claim 11 wherein the bit head and pin body engagement sections are threaded with matching threads, and the drill bit assembly comprises multiple cavities in the form of elongated grooves arranged in a single front-to-tail line and in a reverse thread pattern to the matching threads.

21. A drill bit assembly as claimed in claim 11 further comprising multiple cavities each in the form of a circular dimple and arranged in at least one spaced row extending across at least one of the bit head and pin body engagement sections.

22. A drill bit assembly as claimed in claim 11 wherein the feature in the bit head is a communications port and the feature in the pin body is a communications port, and the drill bit assembly further comprises an electrical conductor extending across the gap joint and into both communication ports.

23. A method of manufacturing a drill bit assembly having a bit head and a pin body; the bit head comprising a cutting end and an opposite connecting end with an engagement section; the pin body comprising a tubular body with an axial bore therethrough and a connecting end with an engagement section; and wherein the bit head and pin body comprise two mating pieces each with a mating end and a feature within a well thereof; the method comprising:

(a) positioning the engagement sections of the pin body and the bit head such that the pin body and the bit head are connected at their connecting ends;

(b) positioning the mating ends of the two pieces of the pin body or the bit head or both such that a gap is formed between the mating ends, and the features in each mating end are aligned;

(b) injecting a connecting material in liquid form between the mating ends and into the gap; and (c) solidifying the connecting material such that the two pieces of the pin body or bit head or both are mechanically coupled together at their mating ends and their features are securely aligned.

24. A drill bit assembly comprising a bit head having a cutting end and an opposite connecting end with an engagement section;

a pin body having a connecting end with an engagement section, the pin body and bit head connecting ends positioned such that the bit head and pin body engagement sections overlap and the pin body and bit head are connected at their connecting ends;

wherein the bit head and pin body comprise two mating pieces each with a mating end and a feature within a well thereof, wherein the mating ends are positioned such that a gap is formed therebetween and the features are aligned; and, an injectable gap joint filling the gap such that the two pieces of the bit head or pin body or both are mechanically coupled together at their mating ends.

25. A drill bit assembly as claimed in claim 24 wherein the pin body and bit head connecting ends are positioned such that a gap is formed between the bit head and pin body engagement sections, and the drill bit assembly further comprises a second gap joint filling the gap such that the bit head and pin body are mechanically coupled together at their connecting ends.

* * * * *